US005601232A

United States Patent [19]

Greenlee

[11] Patent Number: 5,601,232

[45] Date of Patent: Feb. 11, 1997

[54] BOTTOM CLOSURE RESTRAINMENT APPARATUS FOR PALLETIZED BULK BIN CONTAINER

[75] Inventor: James C. Greenlee, El Paso, Tex.

[73] Assignee: Stone Container Corporation, Chicago, Ill.

[21] Appl. No.: 535,611

[22] Filed: Sep. 8, 1995

[51] Int. Cl.[6] ..... B65D 5/32; B65D 5/36

[52] U.S. Cl. ..... 229/117.05; 206/600; 229/23 R

[58] Field of Search ..... 229/117, 117.02, 229/117.03, 117.05, 117.06, 23 R; 206/600

[56] References Cited

U.S. PATENT DOCUMENTS

| | | | |
|---|---|---|---|
| 3,119,547 | 1/1964 | Nute | 229/117.06 |
| 3,642,192 | 2/1972 | Wilcox, Jr. et al. | 229/117.05 |
| 3,770,186 | 11/1973 | Kupersmit | 229/23 R |
| 4,373,637 | 2/1983 | Shippell | 206/600 |
| 4,606,461 | 8/1986 | Bolton, Sr. | 206/600 |
| 4,691,859 | 9/1987 | Snyder | 229/23 R |
| 4,712,687 | 12/1987 | Silcott et al. | 206/600 |
| 4,793,507 | 12/1988 | Delplanque | 206/600 |
| 4,949,898 | 8/1990 | Nederveld | 206/600 |
| 4,969,559 | 11/1990 | Nederveld | 206/600 |
| 5,071,010 | 12/1991 | Carufel/Zeman | 206/600 |
| 5,163,555 | 11/1992 | West et al. | 206/600 |
| 5,301,872 | 4/1994 | Tusing et al. | 229/117.03 |
| 5,318,219 | 6/1994 | Smith | 229/23 R |

*Primary Examiner*—Gary E. Elkins
*Attorney, Agent, or Firm*—Dick and Harris

[57] ABSTRACT

A bottom closure restrainment apparatus for palletized bulk bin containers towards the containment of various articles including bulk materials. A container fixedly attached to a pallet includes a bottom closure restrainment apparatus for aligning and maintaining the bottom flaps of the container in position relative to the pallet.

10 Claims, 2 Drawing Sheets

BOTTOM CLOSURE RESTRAINMENT APPARATUS FOR PALLETIZED BULK BIN CONTAINER

BACKGROUND OF THE INVENTION

The present invention relates in general to a bottom closure restrainment apparatus for a collapsible container apparatus attached to a pallet so as to restrain and retain the position of the bottom flap portions of the container, as attached to the pallet, so as to prevent distortion of the container bottom to, in turn, prevent overall container distortion and/or the migration of materials from within the apparatus to the outside environment when the apparatus is fully deployed and filled.

Pallets have been used for many years by shippers and transporters of various materials. These pallets typically provide a flat and sturdy surface on which materials can be placed and stacked. In order to assure that the materials remain on the pallet, various sized and shaped containers have been attached to the tops of pallets so as to present a bounded area in which to place and/or remove the materials being shipped or stored.

Containers that have been conventionally attached to pallets range from nothing more than four walls and a bottom which utilize the pallet top surface as a support, to more intricate collapsible pallet-container combinations. Most early pallet-container combinations were not collapsible and retained their shape, configuration and dimensions whether in use or not, thereby requiring excess space when stored between uses.

Other configurations of pallet-container combinations allowed for the pallet and container to be formed out of different structural materials, however the extra material required, the extra space required when not in use and the extra costs associated therewith were often prohibitive.

In most prior art pallet-container combinations, the larger the combination is, the less manageable it often becomes. Many such combinations require extensive time and effort to fully deploy the container portion of the combination and provide little, if any retainment of the bottom. There is often a necessity to hold down one portion of the container while attempting to deploy another portion. This arrangement very often necessitates more than one individual to articulate and deploy the container, or conversely to collapse the combination after use.

Further, in such prior art constructions, where the container is attached to the pallet along a lower edge periphery, there often exists gaps between the lower edges of the container and the top surface of the pallet which would allow for the contents within the container to migrate out between the pallet and the lower edges of the container. Alternatively, the bottom is made from separate flap portions which may not be correctly positioned or aligned upon full deployment of the container. In an effort to overcome these undesirable problems, additional flaps must be manually and repetitively deployed to seal the edges and the bottom must be repositioned and held in place thereby requiring further effort, labor costs and time.

Prior art pallet-container combinations include U.S. Pat. No. 5,301,872 to Tusing, et al.; U.S. Pat. No. 4,373,637 to Shippell; U.S. Pat. No. 5,071,010 to Carufel/Zeman; U.S. Pat. No. 4,969,559 to Nederveld.; U.S. Pat. No. 4,949,898 to Nederveld; U.S. Pat. No. 4,793,507 to Delplanque; U.S. Pat. No. 4,880,141 to Gossler, et al.; U.S. Pat. No. 4,712,687 to Silcott, et al.; and U.S. Pat. No. 4,606,461 to Bolton Sr.

While this prior art relates in varying degrees to the present invention, they lack the many advantages of the present invention.

Shippell '367 discloses a pallet-container combination wherein the container portion requires substantial effort to deploy and collapse. Specifically, the bottom flaps 56 and 58 must be manually repositioned during deployment and collapse of the container portion. Furthermore, there are no position alignment features for the bottom flaps—since both bottom flaps are permanently glued to the pallet so as to affect the collapsed profile of the container.

Carufel/Zeman '010; Nederveld '898; Delplanque '507; Gossler '141 Silcott '687; and Bolton Sr. '461 either use the pallet as the actual bottom of the container (without gluing the surface of the bottom flap), have a single flap glued or otherwise fastened to the pallet thereby requiring no alignment or restrainment feature for multiple flaps along the bottom of the container, or simply use no such features at all. The Nederveld '559 and Tusing '872 references, on the other hand do disclose one type of locking feature for the articulateable bottom flaps. However, with such a "keystone" arrangement at the peripheral flap edges only three sides of edge contact are made towards resisting shifting forces, and additional waste material is incurred to form the male tab segment.

It is thus an object of the present invention to create an inexpensive, easy to assemble pallet-container apparatus that can be utilized with a variety of pallets formed into a variety of sizes and out of a variety of materials, having a bottom flap alignment locking feature which improves restraint between two separable flaps while reducing container blank waste.

It is a further object of the invention to provide such a secured container that requires a minimized amount of time and effort, by one individual, to deploy and collapse in only a few operational steps. In so doing, it is an object to achieve automatic prompting towards articulated transition of many of the container's panels and flaps.

An additional object of the invention, is to provide a container portion that has an automatically sealed lower periphery, which is maintained, at least in part, by an efficient bottom closure restrainment feature so as to prevent inadvertent or accidental migration of the contents within the container to the outside environment.

Similarly it is an object to minimize the amount of materials utilized to form such a container and to minimize the overall profile of the container-pallet combination when not in use and fully collapsed.

These and other objects of the invention will become apparent in light of the present specification and drawings.

SUMMARY OF THE INVENTION

The present invention comprises a bottom closure restrainment apparatus for a collapsible pallet container for aligning and retaining the flaps forming the bottom portion of the container upon full articulated deployment so that articles may be positioned within the interior region of the container.

In a preferred embodiment of the invention, the apparatus comprises a pallet and a container attached to the top surface of the pallet. This type of pallet/container combination is shown in Tusing '872. Accordingly, the container moves from a fully collapsed position, as shown in Tusing '872, to a fully articulated and deployed position on top of the pallet.

The container portion comprises a front panel, back panel, two side panels, a bottom panel, and a bottom closure restraint member.

In this preferred embodiment, the bottom panel includes at least two bottom flap portions at least one of which is not affixed to the top of the pallet. Another bottom flap portion is also hingedly emanating from the front panel. Positioned so as to work in association with the unaffixed bottom flap portion is the bottom closure restraint member which comprises of one or more geometrically-shaped apertures and a corresponding number of one or more geometrically-shaped posts.

Preferably there are only two bottom flap portions one of which is not attached to the top of the pallet when the container is in the collapsed position. Within this unattached bottom flap portion is a single geometrically-shaped aperture operably positioned proximate to the center of the unaffixed bottom flap portion. Similarly, a single geometrically-shaped post is operably positioned on the top of the pallet so as to be telescopically received by and engage the single geometrically-shaped aperture within the unaffixed bottom flap portion upon full deployment of the container. Such cooperation of the geometrically-shaped aperture and geometrically-shaped post helps to restrain and align the two portions of the bottom panel and, in turn, the container as a whole when fully deployed.

Alternatively, the bottom panel restraint member may comprise two geometrically-shaped apertures and two corresponding geometrically-shaped posts. In this embodiment, the two geometrically-shaped apertures are again located within the unaffixed bottom flap portion of the bottom panel and preferably positioned equidistant from each other as well as the respective side panels of the container. The corresponding two geometrically-shaped posts are again operably located on top of the pallet so as to cooperate with, be received by and engage both geometrically-shaped apertures towards restraint and alignment of the two portions of the bottom panel.

When the bottom closure restraint member comprises a single geometrically shape aperture and a single geometrically-shaped post, a container including the present invention may be formed out of two integrated unitary blanks of container material. Accordingly, the first blank comprises the front panel, one of the side panels, a portion of the bottom panel which when the container is constructed is the unaffixed bottom flap portion and a single geometrically-shaped aperture while the second blank comprises the back panel, the second side panel, the second portion of the bottom panel which will be affixed to the pallet upon construction of the container and the single geometrically-shaped post which is removable from the waste region of the blank prior to construction of the container.

When the bottom closure restraint member comprises two geometrically-shaped apertures and a two geometrically-shaped posts, a container including the invention may be alternatively formed out of two integrated unitary blanks of material. In this embodiment the first blank comprises the front panel, one of the side panels, a portion of the bottom panel which when the container constructed is the unaffixed bottom flap portion, two geometrically-shaped apertures positioned within the bottom flap portion, and two geometrically-shaped posts which are removable from the waste region of the first blank prior to constructing the container. The second blank comprises the back panel, the second side panel and the second portion of the bottom panel which will be affixed to the top of the pallet when constructing the container. In either the single or double aperture/post arrangement of the present invention, the two blanks of material form a contiguous integrated container when constructed.

These blanks as well as the geometrically-shaped posts may be formed out of many different types of material. While the pallet and the container need not be constructed from the same material, it is envisioned that the container portion, including the geometrically-shaped posts, be constructed out of a substantially biodegradable, paperboard material, preferably corrugated paperboard. The paperboard material may be of varying plies and thickness including single, double or triple wall paperboard. Similarly, the pallet may be formed from a corrugated paperboard material or any other materials that may be appropriate for its function.

BRIEF DESCRIPTION OF THE DRAWINGS

FIG. 9 is a perspective view of the fully articulated and deployed container formed by the blanks of FIGS. 7 and 8 having its two geometrically-shaped posts telescopically received by and engaging said two corresponding geometrically-shaped apertures to restrain the position of the unaffixed bottom flap along the pallet surface.

DETAILED DESCRIPTION OF THE DRAWINGS

Figure 2:
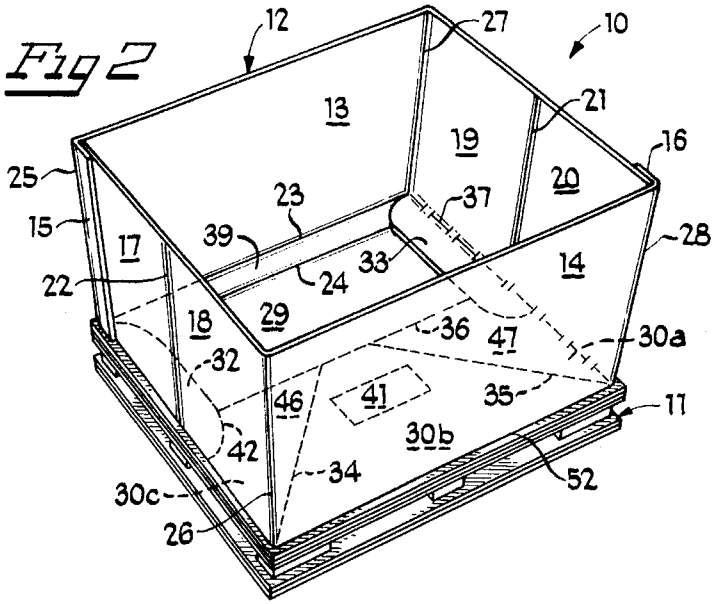
FIG. 2 is a perspective view of a fully articulated and deployed container, with said container having its single geometrically-shaped post engaging said single geometrically-shaped aperture so as to restrain the position of the unaffixed bottom flap along the pallet surface.

While this invention is susceptible of embodiment in many different forms, there are shown in the drawings and will herein be described in detail, several specific embodiments, with the understanding that the present disclosure is to be considered as an exemplification of the principles of the invention and is not intended to limit the invention to the embodiments illustrated.

Figure 1:
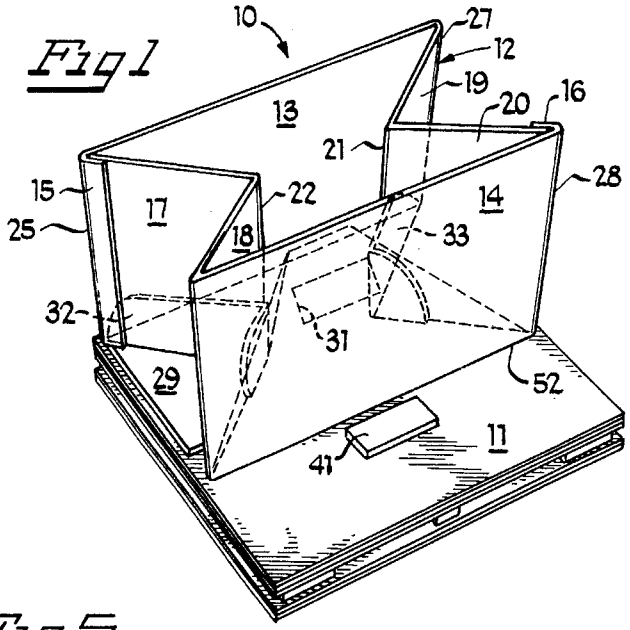
FIG. 1 is a perspective view of a container including the present invention in an intermediate collapsed position with said unaffixed bottom flap portion of said bottom panel moving towards a position adjacent and juxtaposed to said top surface of said pallet means so that said single geometrically-shaped post attached to said pallet means can be telescopically received by said single geometrically-shaped positioning aperture.

Bottom closure restrainment apparatus 10 is shown in FIG. 1 with container 12 in an intermediate collapsed position, where bottom flap portion 29 of container 12 remains juxtaposed to and restrainably affixed to pallet means 11. Bottom flap portion 29 is further hingedly attached to back panel means 13. As can be seen in FIG. 1, container 12 is only partially collapsed so that front, back and side panel means 14, 13, 18-17 and 19-20, respectively, are substantially vertical as well as perpendicular to pallet means 11. Geometrically-shaped aperture 31 is positioned approximate to the center of bottom flap portion 30 while geometrically-shaped post 41 has already been attached to the top of pallet means 11 so as to be telescopically received and encircled by aperture 31 when container 12 is fully deployed.

FIG. 2 demonstrates container 12 in its fully articulated and deployed position. Front panel 14, back panel 13, and side panels 17-18 and 19-20 are all substantially vertical and perpendicular to both bottom panel 29-30 and pallet means 11. Bottom panel 29-30 overlies and attaches to pallet means 11 at bottom flap portion 29 so as to substantially cover the entirety of the top surface of pallet means 11. In the fully deployed position, the single geometrically-shaped post 41, now being affixed to pallet means 11, is operably engaged by geometrically-shaped aperture 31 so as to restrain bottom flap portion 30. In addition, the aperture 31 and post 41 combination cooperate to align and maintain the positions of respective bottom flap portions 29 and 30 along edge 36 to reinforce the integrity of the bottom panel 29-30 and, in turn, container 12, so as to prevent accidental collapse.

Figure 3:
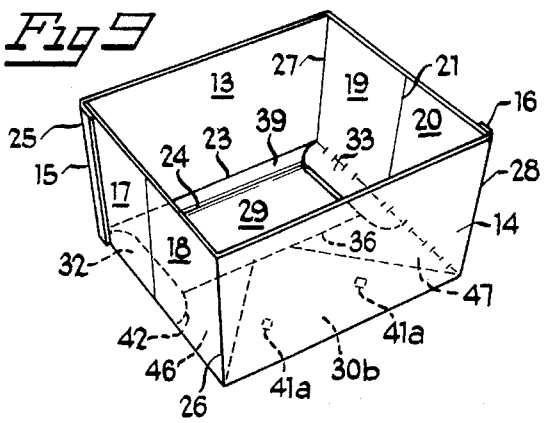
FIG. 3 is a top plan view of a container in another intermediary collapsed position in which said single geometrically-shaped post remains attached to said pallet means and said single geometrically-shaped aperture has disengaged from said post.
Figure 4:
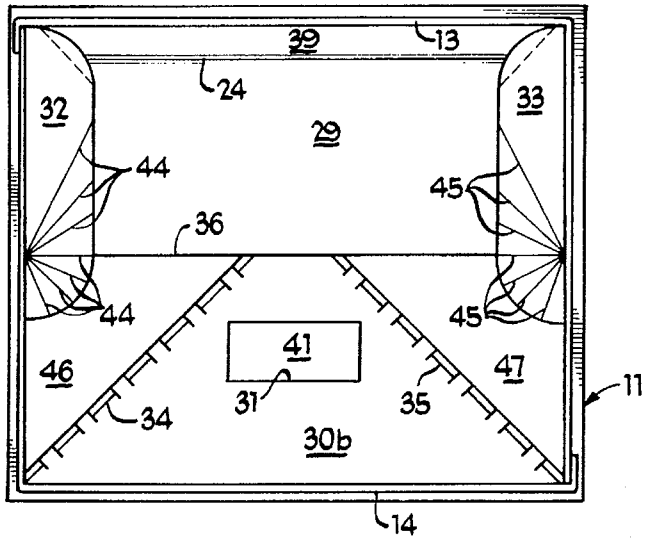
FIG. 4 is a top plan view of the fully deployed container of FIG. 2 in which the single geometrically-shaped post is telescopically received and encircled by the similarly shaped geometrically-shaped aperture.

As better shown in FIG. 3, pallet means 11 is affixed to container 12 at bottom flap portion 29 which is also hingedly attached to back panel 13. Upon full deployment of the container apparatus, as shown sequentially in FIGS. 3 and 4, unaffixed bottom flap portion 30 moves from a collapsed configuration within container 12 to a position substantially parallel to pallet means 11 and perpendicular to front, back and side panels 14, 13, 17, 18, and 19-20, respectively when in the fully deployed configuration. Bottom panel 29-30, as shown in FIG. 4, covers substantially the entirety of the surface area bounded by pallet means 11, with the bottom panel at least partially maintained in proper predetermined position along edge 36 by the bottom closure restraint member through the cooperation of geometrically-shaped aperture 31 engaging the corresponding geometrically-shaped post 41.

Figure 5:
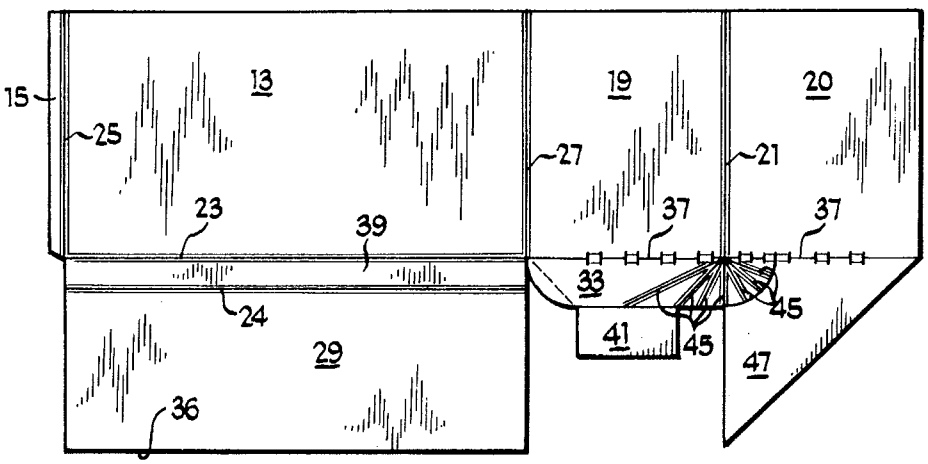
FIG. 5 of the drawings is an elevated view of a non-articulated, integrated container blank, comprising a single unitary sheet of material containing a back panel, a first side panel, a portion of said bottom panel and a single geometrically-shaped post within a waste material region.
Figure 6:
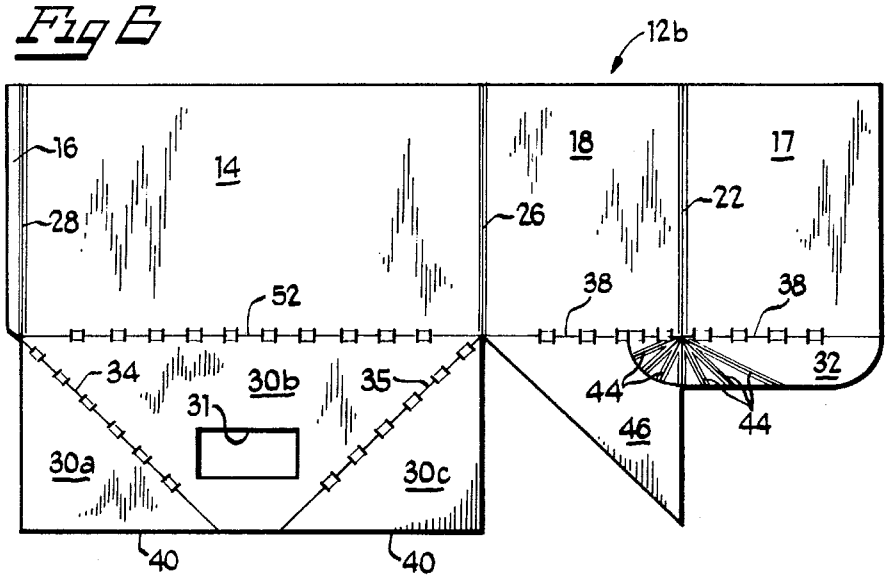
FIG. 6 of the drawings is an elevated view of a non-articulated, integrated container blank, comprising a single unitary sheet of material containing a front panel, a second side panel, a portion of the bottom panel which comprises the unaffixed bottom flap portion in which a single geometrically-shaped aperture has been positioned.

Integrated container blank **12*a* is shown in FIG. 5 as including back panel 13 hingedly attached to bottom flap portion 29-39 and similarly attached to side panels 19-20. Geometrically-shaped post 41 is also operably attached to blank 12*a* so as to be readily removed and repositioned upon the top of pallet means 11 when container 12 is constructed. FIG. 6 shows matching integrated container blank 12*b* for attachment to blank 12*a*. In this blank, front panel 14 is hingedly attached to bottom flap portion 30 as well as side panel 18-17. Aperture 31 of bottom closure restraint member 31-41 is operably located proximate to the center of bottom flap portion 30 so that, upon articulation and full deployment of container 12, it operably engages and receives post 41 of container blank 12*a***.

Figure 7:
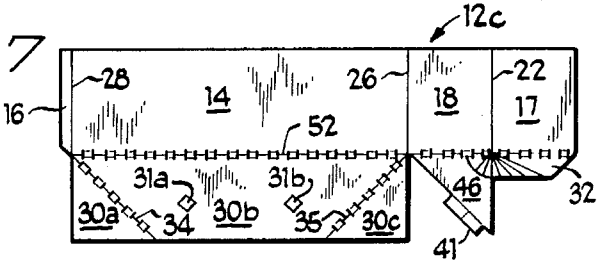
FIG. 7 of the drawings is an elevated view of a non-articulated, integrated container blank, comprising a single unitary sheet of material containing a front panel, a side panel, a portion of said bottom panel which comprises said unafffixed bottom flap portion in which two geometrically-shaped apertures have been positioned and a two geometrically-shaped posts within a waste material region.
Figure 8:
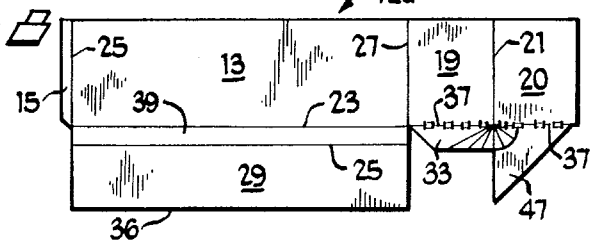
FIG. 8 of the drawings is an elevated view of a non-articulated, integrated container blank, comprising a single unitary sheet of material containing a back panel, a second side panel, a portion of the bottom panel.
Figure 3:
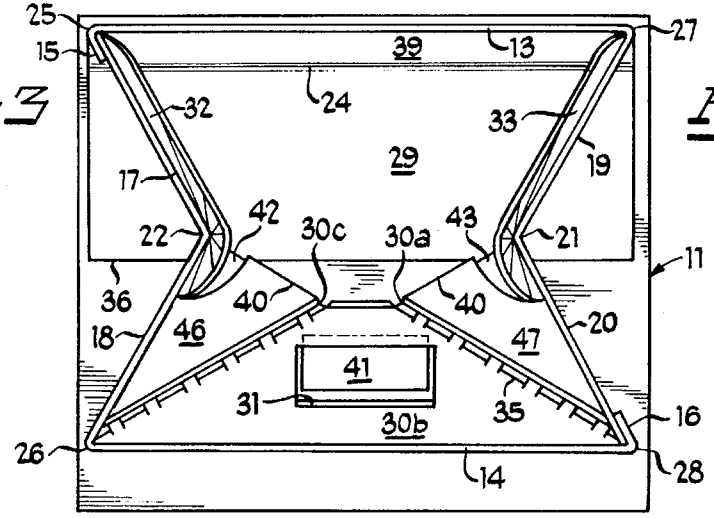

FIG. 7 shows an alternative embodiment for the apparatus 10 so that container blank **12*c* is similar to that of blank 12*b* of FIG. 6. However, in this embodiment blank 12*c* contains two geometrically-shaped apertures 31*a* and 31*b* operably located within bottom flap portion 30, positioned equidistant from each other as well as from the respective side panels 18-17 and 19-20 upon full deployment of container 12. Also temporarily attached to blank 12*c* are corresponding geometrically-shaped posts 41*a*, which are shown prior to removal from the blank. Geometrically-shaped posts 41*a* are then severed from blank 12*c* and are fixed into place upon the top of pallet means 11 by such means as adhesive. The matching blank of 12*d* is shown in FIG. 8 for connection to blank 12*c* so as to complete container 12. Container 12 of this alternative embodiment is shown in the deployed position in FIG. 9 so that the posts of 41*a* are encircled and engaged by apertures 31*a* and 31*b***.

The foregoing description and drawings merely explain and illustrate the invention and the invention is not limited thereto except as the appended claims are so limited, as those skilled in the art who have the disclosure before them will be able to make modifications and variations therein without departing from the scope of the invention.

What is claimed is:

1. A bottom closure restrainment apparatus for a palletized bulk bin container for aligning and restraining at least two juxtaposed flaps forming a bottom of said container when said container is fully deployed upon articulation from an undeployed position for restrained receipt of articles therewithin an interior region of said container during containment, storage and transportation of said articles, said bottom closure restrainment apparatus comprising:

pallet means for supporting and moving said container, said pallet means having a top surface on which said container is positioned;

said container bottom including a bottom panel having a front edge, a back edge and one or more side edges;

said bottom panel comprising at least two bottom flap portions, at least one of which is not affixed to said pallet means in said undeployed position;

bottom closure restraint means for maintaining said at least two bottom flap portions in restrained aligned position relative to each other upon articulation of said container to said deployed position; and said bottom closure restraint means comprising one or more geometrically-shaped apertures in said at least one unaffixed bottom flap portion and one or more corresponding post elements emanating from the top surface of said pallet means for operable telescopically mated receipt within said one or more apertures to restrain and align the position of said at least one unaffixed bottom flap portion in a position restrainably juxtaposed to another of said at least two flap positions.

2. The bottom closure restrainment apparatus according to claim 1 in which:

said container includes a front, back and two side panels;

said at least two bottom flap portions comprising two bottom flap portions in which said at least one unaffixed bottom flap portion is hingedly attached to at least one of said front, back and two side panels of said container.

3. The bottom closure restrainment apparatus according to claim 1 in which said one or more geometrically-shaped apertures comprises a single geometrically-shaped aperture and said one or more corresponding post element comprise a single corresponding post;

said single geometrically-shaped aperture operably positioned approximately equidistant from said side edges of said unaffixed bottom flap portion; and said corresponding single post operably emanating from said pallet means so as to be telescopically received by and protrude into said geometrically-shaped aperture located within said unaffixed bottom panel flap portion.

4. The bottom closure restrainment apparatus according to claim 1 in which said one or more geometrically-shaped apertures comprises two geometrically-shaped apertures and said one or more corresponding geometrically-shaped post element comprises two geometrically-shaped post;

said two geometrically-shaped apertures being operably positioned within said unaffixed bottom flap portion so to be approximately equidistant from each other as well as equidistant from said respective side panels upon deployment; and said two geometrically-shaped posts operably emanating from said pallet means so as to be telescopically received and protrude into respective ones of said two geometrically-shaped apertures located within said unaffixed bottom flap portion when said container is articulated into said deployed position.

5. The bottom closure restrainment apparatus according to claim 2 in which said container is operably formed out of a first and second blank of material;

said first blank of material including said back panel, a portion of said bottom panel, a first of said two side panels, and said corresponding one or more geometrically-shaped post elements;

said corresponding one or more geometrically-shaped post elements formed from within said first blank of material for removal therefrom and, in turn, proper positioning upon said pallet means prior to assembly and deployment of said container; and said second blank of material including said front panel, at least a second portion of said bottom panel and a second of said two side panels.

6. The bottom closure restrainment apparatus according to claim 1 wherein said container is formed out of a substantially biodegradable material.

7. The bottom closure restrainment apparatus according to claim 1 wherein said container is formed out of a paperboard material.

8. The bottom closure restrainment apparatus according to claim 7 wherein said container is formed out of a corrugated paperboard material.

9. The bottom closure restrainment apparatus according to claim 8 wherein said container and said one or more geometrically-shaped post elements are formed out of a double-wall corrugated paperboard material.

10. The bottom closure restrainment apparatus according to claim 9 wherein said container and said one or more geometrically-shaped post elements are formed out of a triple wall corrugated paperboard material.

* * * * *